US010856712B2

(12) United States Patent
Ni

(10) Patent No.: US 10,856,712 B2
(45) Date of Patent: Dec. 8, 2020

(54) THREE-TIER CYCLONE DUST BIN FILTRATION SYSTEM AND VACUUM CLEANER COMPRISING THE SYSTEM

(71) Applicant: KINGCLEAN ELECTRIC CO., LTD., Suzhou, Jiangsu (CN)

(72) Inventor: Zugen Ni, Suzhou (CN)

(73) Assignee: KINGCLEAN ELECTRIC CO., LTD., Jiangsu (CN)

( * ) Notice: Subject to any disclaimer, the term of this patent is extended or adjusted under 35 U.S.C. 154(b) by 274 days.

(21) Appl. No.: 15/770,952

(22) PCT Filed: Nov. 13, 2015

(86) PCT No.: PCT/CN2015/094550

§ 371 (c)(1),
(2) Date: Apr. 25, 2018

(87) PCT Pub. No.: WO2017/075844

PCT Pub. Date: May 11, 2017

(65) Prior Publication Data

US 2018/0325340 A1 Nov. 15, 2018

(30) Foreign Application Priority Data

Nov. 3, 2015 (CN) ..... 2015 1 0736706

(51) Int. Cl.
*A47L 9/16* (2006.01)
*A47L 9/12* (2006.01)
(Continued)

(52) U.S. Cl.
CPC ..... *A47L 9/1691* (2013.01); *A47L 5/225* (2013.01); *A47L 5/24* (2013.01); *A47L 9/122* (2013.01);
(Continued)

(58) Field of Classification Search
CPC ..... A47L 5/225; A47L 5/24; A47L 9/122; A47L 9/1625; A47L 9/1633; A47L 9/1683; A47L 9/1691
See application file for complete search history.

(56) References Cited

U.S. PATENT DOCUMENTS 10,076,217 B2 * 9/2018 Conrad ..... A47L 5/32
2009/0205162 A1 * 8/2009 Oh ..... B04C 7/00 15/353

(Continued)

FOREIGN PATENT DOCUMENTS

CN 101015436 A 8/2007
CN 102429612 A * 5/2012

(Continued)

OTHER PUBLICATIONS

Extended European Search Report corresponding to Application No. 15907686.8-1018/3372137 PCT/CN2015094550; dated May 29, 2019.

(Continued)

*Primary Examiner* — Marc Carlson
(74) *Attorney, Agent, or Firm* — Cantor Colburn LLP

(57) ABSTRACT

A three-tier cyclone dust bin filtration system and a vacuum cleaner comprising the system. The filtration system comprises a tier one filtration apparatus and a spiral tier two dust-air separation apparatus in communication with an air outlet of the tier one filtration apparatus and provided with two tiers of filtration structures, where the spiral tier two dust-air separation apparatus is detachably fixed onto the tier one filtration device. The vacuum cleaner comprises a floor brush, a push rod, a main machine, and the three-tier cyclone dust bin filtration system.

10 Claims, 2 Drawing Sheets

(51) Int. Cl.
*A47L 5/22* (2006.01)
*A47L 5/24* (2006.01)

(52) U.S. Cl.
CPC ..... *A47L 9/1625* (2013.01); *A47L 9/1633* (2013.01); *A47L 9/1683* (2013.01)

(56) References Cited

U.S. PATENT DOCUMENTS

| | | | | |
|---|---|---|---|---|
| 2011/0289719 | A1 | 12/2011 | Han et al. | |
| 2013/0091815 | A1* | 4/2013 | Smith | A47L 9/0045 55/346 |
| 2013/0160233 | A1* | 6/2013 | Peace | A47L 9/1625 15/353 |
| 2018/0177363 | A1* | 6/2018 | Ni | A47L 9/10 |
| 2018/0296047 | A1* | 10/2018 | Ni | A47L 5/24 |

FOREIGN PATENT DOCUMENTS

| | | | | |
|---|---|---|---|---|
| CN | 102429612 | A | | 5/2012 |
| CN | 203122295 | U | | 8/2013 |
| CN | 103519570 | A | | 1/2014 |
| CN | 104545695 | A | | 4/2015 |
| CN | 104840150 | A | | 8/2015 |
| CN | 104840152 | A | | 8/2015 |
| CN | 204698451 | U | * | 10/2015 |
| CN | 204698451 | U | | 10/2015 |
| CN | 205338842 | U | | 6/2016 |
| EP | 2389849 | A2 | | 11/2011 |
| EP | 2581009 | A1 | | 4/2013 |
| KR | 100667884 | B1 | | 1/2007 |
| KR | 20110132196 | A | | 12/2011 |
| WO | 2008070966 | A1 | | 6/2008 |

OTHER PUBLICATIONS

Korean Notification of Reason for Refusal corresponding to Application No. 10-2018-7012740; dated Apr. 18, 2019.
International Search Report corresponding to Application No. PCT/CN2015/094550; dated Aug. 18, 2016.

* cited by examiner

THREE-TIER CYCLONE DUST BIN FILTRATION SYSTEM AND VACUUM CLEANER COMPRISING THE SYSTEM

The present application is the national phase of International Application No. PCT/CN2015/094550, titled "THREE-TIER CYCLONE DUST BIN FILTRATION SYSTEM AND VACUUM CLEANER COMPRISING THE SYSTEM", filed on Nov. 13, 2015 which claims the priority to Chinese Patent Application No. 201510736706.9 titled "THREE-STAGE CYCLONE DUST CUP FILTRATION SYSTEM AND VACUUM CLEANER COMPRISING THE SYSTEM", filed with the Chinese State Intellectual Property Office on Nov. 3, 2015, the entire disclosure of which applications are incorporated herein by reference.

FIELD

The present application relates to the technical field of design of vacuum cleaner filtration system, and particularly relates to a three-stage cyclone dust cup filtration system and a vacuum cleaner including the system.

BACKGROUND

A vacuum cleaner is a cleaning appliance which uses a motor to drive blades to rotate at a high speed, generates negative air pressure inside a sealed housing to suck dust into a dust collecting device, and discharges the filtered air out of a fan at an extremely high speed. The vacuum cleaners include dry vacuum cleaners and wet-dry vacuum cleaners according to the functional classification, and the dry vacuum cleaners generally include a dust bag type vacuum cleaner and a dust cup type vacuum cleaner.

The conventional dust cup type vacuum cleaners generally include two stages of dust-air separation structures, in which a first-stage structure is used to filtrate large dirt in the air, and a second-stage structure is used to separate and collect small impurities such as dust particles. The conventional two-stage dust-air separation structure generally forms two-stage cyclone through the cooperation of a cover plate of a dust cup filter and a cyclonic body having several cyclonic openings. Such a structure requires many components, relatively more and complex molds and assembly processes are involved and the sealing of each step is difficult to control, therefore air and dust leakage phenomena are apt to occur and thereby adversely affecting a comprehensive performance of the overall unit.

Besides, in a dust cup filtration system of the vacuum cleaner, a cyclone filtration system with a dust bag or a single dust cup is basically employed. The dust and hair or the like directly enter the dust cup through an air channel for separation and filtration, therefore tiny dust and large dust particles such as hair and the like enter the dust cup together. A single-stage cyclone structure is not conducive to separating tiny dust, while for a two-stage cyclone structure, hair is easily wrapped on a cone, which is not conducive to separating the dust, and easily causes High Efficiency Particulate Air filter (HEPA) to be blocked, therefore the air quantity loss increases, and the dust storage capacity of the overall unit is relatively small.

In view of the above problems, it is necessary to provide a new filtration system to effectively increase the dust storage capacity of the overall unit, to improve the separation efficiency of the dust cup, to reduce the air loss, thereby facilitating cleaning for users, simplifying the structure and making the dust discharge convenient.

SUMMARY

In view of this, a three-stage cyclone dust cup filtration system and a vacuum cleaner including the system are provided according to the present application. The filtration system includes a detachably arranged spiral two-stage dust-air separation device and a first-stage filtration device, and three times separation of the dust is realized, which improves the separation efficiency of the dust cup, reduces the air loss, facilitates cleaning for users, simplifies the structure and makes the dust discharge convenient, and can effectively increase the dust storage capacity of the overall unit.

The three-stage cyclone dust cup filtration system provided according to an object of the present application includes a first-stage filtration device, and a spiral two-stage dust-air separation device having two stages of filtration structures and in communication with an air outlet of the first-stage filtration device, wherein the spiral two-stage dust-air separation device is detachably fixed onto the first-stage filtration device;

the first-stage filtration device includes a large dust cup and a filter screen arranged inside the large dust cup, a gap is provided between the filter screen and an inner wall of the large dust cup, the gap is configured to form a cyclone air channel of the first-stage filtration device, and a first dust collection space is defined between the filter screen and the large dust cup;

the spiral two-stage dust-air separation device is a handheld vacuum cleaner, the air with dust enters the first-stage filtration device via a first air inlet channel, after a first-stage dust-air separation by the filter screen, at least a part of the air with dust is led through a second air inlet channel into a cyclone cylinder of the spiral two-stage dust-air separation device for a second-stage dust-air separation, and is collected in a second dust collection space; then at least a part of the air with dust is led through a third air inlet channel to spiral fan blades of the spiral two-stage dust-air separation device for a third-stage dust-air separation, and is collected in a third dust collection space, the air in the swirling airflow is extracted by a negative pressure, thereby realizing the third-stage dust-air separation.

Preferably, a large cover plate is arranged at an upper portion of the large dust cup, a middle portion of the large cover plate caves downward to form a placement space for placing the handheld vacuum cleaner, and a lower end of the handheld vacuum cleaner is mounted in the placement space.

Preferably, a clamping connector is formed in the placement space, and the lower end of the handheld vacuum cleaner is fixedly clamped in the placement space.

Preferably, the placement space is tapered from top to bottom, and presents a tapered cylinder shaped structure.

Preferably, the filter screen is fixedly arranged on a connecting portion at a lower end of the placement space.

Preferably, the large dust cup is detachably arranged at a lower side the large cover plate.

Preferably, the large cover plate includes two portions arranged up and down, structures of the two portions are spliced to form a large air channel, and the large air channel is in communication with the first dust collection space.

Preferably, an interior of the large air channel is of a spiral surface structure.

Preferably, an air inlet of the spiral two-stage dust-air separation device is located at a bottom, the second air inlet channel extends from a position of the air inlet to an upper end of the spiral two-stage dust-air separation device through a lateral side of the separation device.

A vacuum cleaner includes a floor brush, a push rod, a main body and the three-stage cyclone dust cup filtration system. The large cover plate is fixedly connected to the push rod, the push rod is of a hollow structure, and the large air channel on the large cover plate is in communication with a hollow chamber of the push rod. Dust and the air enters the hollow chamber of the push rod from the floor brush and enters the three-stage cyclone dust cup filtration system through the large air channel on the large cover plate for filtration and separation, and the separated air enters the main body portion of the handheld vacuum cleaner to be discharged.

Compared with the conventional technology, the three-stage cyclone dust cup filtration system and the vacuum cleaner including the system according to the present application have the advantages that:

the filtration system includes the detachably arranged spiral two-stage dust-air separation device and the first-stage filtration device, the air with dust enters the first-stage filtration device via the first air inlet channel, after the first-stage dust-air separation by the filter screen, at least a part of the air with dust is led through the second air inlet channel into the cyclone cylinder of the spiral two-stage dust-air separation device for the second-stage dust-air separation, and is collected in the second dust collection space. Then at least a part of the air with dust is led through the third air inlet channel to spiral fan blades of the spiral two-stage dust-air separation device for the third-stage dust-air separation, and is collected in the third dust collection space. Finally, the air in the swirling airflow is extracted by the negative pressure, thereby realizing the third-stage dust-air separation. The filtration system includes a large dust cup and a handheld vacuum cleaner dust cup, which not only increases the dust storage capacity of the overall unit, but also improves the separation efficiency of the dust cups and reduces the air loss. The separation efficiency of the large dust cup is above 95%, which is significantly improved compared with a first-stage cyclone system of a same type. Through three times of cyclonic dust-air separation, the HEPA is not apt to be blocked, thereby reducing the HEPA cleaning for users. Besides, large-particle dust and fine-particle dust are separated into two dust cups, that is, the large dust cup and the dust cup of the handheld vacuum cleaner, respectively, which facilitates the cleaning for users, and the large dust cup is simple in structure and convenient for dust discharge.

BRIEF DESCRIPTION OF THE DRAWINGS

For more clearly illustrating embodiments of the present application or the technical solutions in the conventional technology, drawings referred to describe the embodiments or the conventional technology will be briefly described hereinafter. Apparently, the drawings in the following description are only some examples of the present application, and for those skilled in the art, other drawings may be obtained based on these drawings without any creative efforts.

Figure 1:
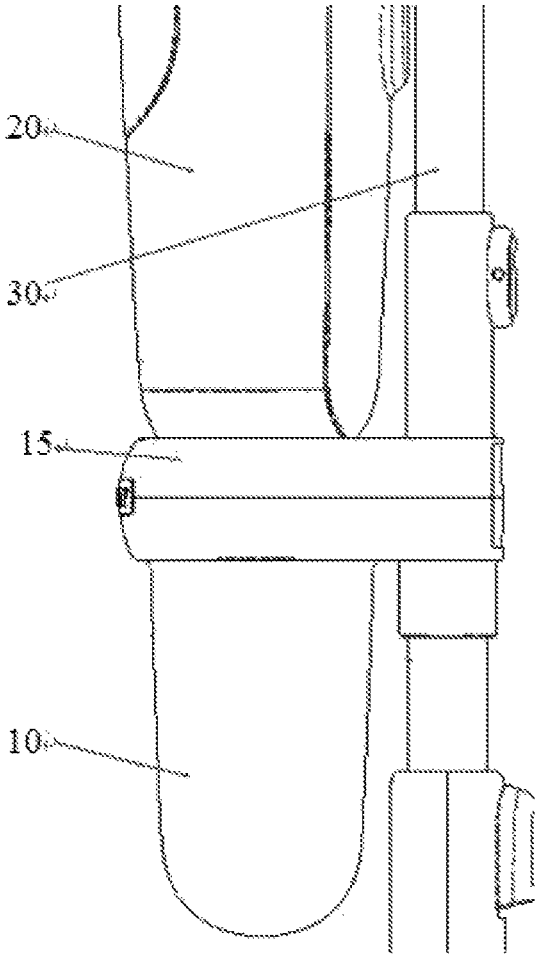
FIG. 1 is a structural view showing a three-stage cyclone dust cup filtration system according to the present application.
Figure 2:
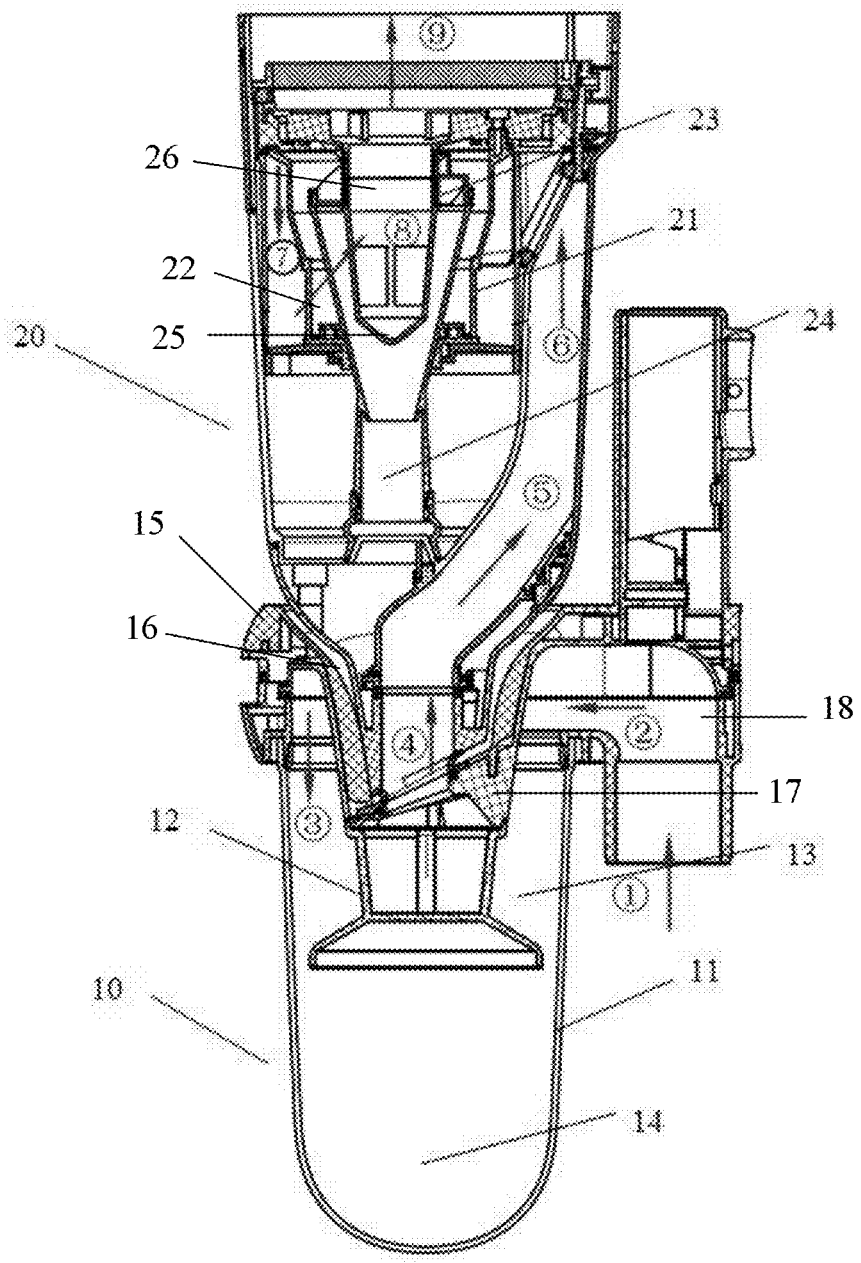
FIG. 2 is a sectional view showing the three-stage cyclone dust cup filtration system according to the present application.

Corresponding relationships between reference numerals or letters and components in FIGS. 1 and 2:

| | | | |
|---|---|---|---|
| 10 | first-stage filtration device, | 11 | large dust cup, |
| 20 | spiral two-stage dust-air separation device, | 13 | cyclone air channel, |
| 30 | push rod, | 15 | large cover plate, |
| 12 | filter screen, | 17 | clamping connector, |
| 14 | first dust collection space, | 21 | cyclone cylinder, |
| 16 | placement space, | 23 | spiral fan blade, |
| 18 | large air channel, | 25 | cyclone cone, |
| 22 | second dust collection space, | | |
| 24 | third dust collection space, | | |
| 26 | sponge rubber. | | |

DETAIL DESCRIPTION

In a dust cup filtration system of the vacuum cleaner, a cyclone filtration system with a dust bag or a single dust cup is basically employed. The dust and hair or the like directly enter the dust cup through an air channel for separation and filtration, therefore tiny dust and large dust particles such as hair and the like enter the dust cup together. A first-stage cyclone structure is not conducive to separating tiny dust, while for a two-stage cyclone structure, hair is easily wrapped on a cone, which is not conducive to separating the dust, and easily causes HEPA blockage, therefore the air loss increases, and the dust storage capacity of the overall unit is relatively small.

A two-stage dust-air separation structure and a dust cup including the structure (application No. 201510044589.X) are disclosed in the conventional technology, and the application discloses a two-stage dust-air separation system, however, the above technical problems still exist when the structure is in use.

In view of the disadvantages in the conventional technology, a three-stage cyclone dust cup filtration system and a vacuum cleaner including the system are provided according to the present application. The filtration system includes a detachably arranged spiral two-stage dust-air separation device and a first-stage filtration device, therefore the dust is separated three times, which improves the separation efficiency of the dust cup, reduces the air loss, facilitates cleaning for users, simplifies the structure and makes the dust discharge convenient, and can effectively increase the dust storage capacity of the overall unit.

The technical solution according to the embodiments of the present application will be described clearly and completely as follows in conjunction with the accompany drawings in the embodiments of the present application. It is obvious that the described embodiments are only a part of the embodiments according to the present application, rather than all of the embodiments. All the other embodiments obtained by those skilled in the art based on the embodiments in the present application without any creative work belong to the scope of the present application.

Referring to both FIGS. 1 and 2, as shown in the figures, a three-stage cyclone dust cup filtration system includes a first-stage filtration device 10, and a spiral two-stage dust-air separation device 20 which has two stages of filtration structures and is in communication with an air outlet of the first-stage filtration device 10, and the spiral two-stage dust-air separation device 20 is detachably fixed onto the first-stage filtration device.

Wherein, the spiral two-stage dust-air separation device is a handheld vacuum cleaner, and the handheld vacuum cleaner is detachably fixed to the first-stage filtration device. In use, the handheld vacuum cleaner may be mounted to the first-stage filtration device for use, and may also be detached from the first-stage filtration device and used separately, thus the application range is large. By the cooperation of the handheld vacuum cleaner and the first-stage filtration device, three-stage dust-air separation of the vacuum cleaner is realized based on the original handheld vacuum cleaner having a two-stage dust-air separation function, thus increases the separation efficiency of the dust cups, reduces the air loss and facilitates cleaning for users.

The first-stage filtration device 10 includes a large dust cup 11 and a filter screen 12 arranged inside the large dust cup 11, a gap is provided between the filter screen 12 and an inner wall of the large dust cup 11, the gap is configured to form a cyclone air channel 13 of the first-stage filtration device, and a first dust collection space 14 is formed between the filter screen 12 and the large dust cup 11. The large-particle dust and the like after being separated by the filter screen falls into the first dust collection space.

During operation, the air with dust enters the first-stage filtration device 10 via a first air inlet channel of, after a first-stage dust-air separation by the filter screen 12, at least a part of the air with dust is led into a cyclone cylinder 21 of the spiral two-stage dust-air separation device 20 for a second-stage dust-air separation through a second air inlet channel, and is collected in a second dust collection space 22; then at least a part of the air with dust is led through a third air inlet channel to spiral fan blades 23 of the spiral two-stage dust-air separation device for a third-stage dust-air separation, and is collected in a third dust collection space 24, and the air in the swirling airflow is extracted by a negative pressure, thereby realizing the third-stage dust-air separation.

A large cover plate 15 is arranged at an upper portion of the large dust cup 11, a middle portion of the large cover plate 15 is concaved downward to form a placement space 16 for placing the handheld vacuum cleaner, and a lower end of the handheld vacuum cleaner is mounted inside the placement space. In order to ensure the stability of the handheld vacuum cleaner, a clamping connector 17 is formed in the placement space, and the lower end of the handheld vacuum cleaner is fixedly clamped inside the placement space.

The placement space 16 is tapered from top to bottom, and presents a tapered cylinder shaped structure to facilitate the placement of the handheld vacuum cleaner.

The filter screen 12 is fixedly arranged on a connecting portion at a lower end of the placement space, and is detachably connected, so as to facilitate detachment for cleaning and so on.

The large dust cup 11 is detachably arranged at a lower side of the large cover plate. The large dust cup is used to store large-particle dust and so on, and most of the dust is separated out during the first-stage dust-air separation process and falls into the large dust cup. By arranging the large dust cup detachably, the dust discharge is convenient, and by arranging the large dust cup to be used in combination with the handheld vacuum cleaner dust cup, the dust storage capacity of the overall unit can be effectively increased.

The large cover plate 15 includes two portions arranged up and down, structures of the two portions are spliced to form a large air channel 18, which is in communication with the first dust collection space 14. Wherein an interior of the large air channel 18 is of a spiral surface structure. After entering the large air channel, the dust and air, guided by the spiral surface structure, gradually accelerates and swirls downward; meanwhile, a certain negative pressure is generated to facilitate the entrance of the dust and air.

An air inlet of the spiral two-stage dust-air separation device is located at a bottom, the second air inlet channel extends from the position of the air inlet to an upper end of the spiral two-stage dust-air separation device through one lateral side of the separation device, so as to facilitate the dust and air after the first-stage dust-air separation entering for the second-stage and third-stage dust-air separations.

A vacuum cleaner, including a floor brush, a push rod 30, a main body and the three-stage cyclone dust cup filtration system. The large cover plate is fixedly connected to the push rod 30, the push rod is of a hollow structure, and the large air channel at the large cover plate is in communication with a hollow chamber of the push rod. The dust and air enters the hollow chamber of the push rod via the floor brush and enters the three-stage cyclone dust cup filtration system through the large air channel at the large cover plate for filtration and separation, and the separated air enters the main body portion of the handheld vacuum cleaner to be discharged.

The vacuum cleaner can perform three times of dust-air separation, the large-particle dust, paper scrapes and hairs are separated out first, in order to improve the separation efficiency, avoid the blockage of filtration HEPA, and reduce the air loss. The overall cyclone system can keep the large-particle dust and hairs in the large dust cup first, and fine-particle dust enters the handheld dust cup to be separated again, therefore facilitates cleaning of the dust cup for users.

The operation principle of the present application is described as follows:

a moving direction of the dust and air is shown by arrows in the figure, the dust and air enters the large dust cup 11 (as shown by $\hat{1}$ in FIG. 2) via the large air channel 18, and enters the first-stage filtration device through the first air inlet channel (identified as $\hat{2}$ and $\hat{3}$ in FIG. 2). After being thrown by the spiral surface of the large air channel, large dust moves spirally downward along an air cone and falls into the large dust cup, and the air with a part of fine-particle dust passes through the large dust cup and enters into the spiral two-stage dust-air separation device. By this time, the large-particle dust and hair remain in the large dust cup, and only a part of fine dust enters into the spiral two-stage dust-air separation device. At this time, the dust and air enters the spiral two-stage dust-air separation device through the second air inlet channel (identified as $\hat{4}$, $\hat{5}$, $\hat{6}$ and $\hat{7}$ in FIG. 2). The fine-particle passes through the cyclone cylinder of the spiral two-stage dust-air separation device to be separated and then enters the spiral fan blades for separation again. By this time, almost all of the fine dust is separated out to remain in the dust cup of the handheld vacuum cleaner, and the air with a part of the tiny dust enters the sponge rubber (identified as $\hat{8}$ in FIG. 2, which represents the third air inlet channel) through the cyclone cone 25, after being filtrated by the sponge rubber 26, the clean air enters a motor via $\hat{9}$, thus realizing the complete separation of the dust and the air. The system not only increases the dust storage capacity of the overall unit, but also reduces the air loss. Through three times of cyclonic dust-air separation, the HEPA is not apt to be blocked, thereby reducing cleaning of the HEPA for users. Besides, large-particle dust and fine-particle dust are separated into two dust cups, that is, the large dust cup and the dust cup of the handheld vacuum cleaner, respectively, which facilitates the cleaning for users, and the large dust cup is simple in structure and convenient for dust discharge.

A three-stage cyclone dust cup filtration system and a vacuum cleaner including the system are provided according to the present application, the filtration system includes the detachably arranged spiral two-stage dust-air separation device and the first-stage filtration device. The air with dust enters the first-stage filtration device via the first air inlet channel, after the first-stage dust-air separation by the filter screen, at least a part of the air with dust is led through the second air inlet channel into the cyclone cylinder of the spiral two-stage dust-air separation device for the second-stage dust-air separation, and is collected in the second dust collection space. Then at least a part of the air with dust is led through the third air inlet channel to spiral fan blades of the spiral two-stage dust-air separation device for the third-stage dust-air separation, and is collected in the third dust collection space, the air in the swirling airflow is extracted by the negative pressure, thereby realizing the third-stage dust-air separation. The system not only increases the dust storage capacity of the overall unit, but also improves the separation efficiency of the dust cups and reduces the air loss. The separation efficiency of the large dust cup is above 95%, which is significantly improved compared with a first-stage cyclone system of the same type. Through three times of cyclonic dust-air separation, the HEPA is not apt to be blocked, thereby reducing cleaning of the HEPA for users. Besides, large-particle dust and fine-particle dust are separated into two dust cups, that is, the large dust cup and the dust cup of the handheld vacuum cleaner, respectively, which facilitates the cleaning for users, and the large dust cup is simple in structure and convenient for dust discharge.

Based on the above description of the disclosed embodiments, those skilled in the art is capable of carrying out or using the present application. It is obvious for those skilled in the art to make many modifications to these embodiments. The general principle defined herein may be applied to other embodiments without departing from the spirit or scope of the present application. Therefore, the present application is not limited to the embodiments illustrated herein, but should be defined by the broadest scope consistent with the principle and novel features disclosed herein.

What is claimed is:

1. A three-stage cyclone dust cup filtration system, comprising a first-stage filtration device, and a spiral two-stage dust-air separation device which has two stages of filtration structures and is in communication with an air outlet of the first-stage filtration device, wherein the spiral two-stage dust-air separation device is detachably fixed onto the first-stage filtration device;

the first-stage filtration device comprises a large dust cup and a filter screen arranged inside the large dust cup, a gap is provided between the filter screen and an inner wall of the large dust cup, the gap is configured to form a cyclone air channel of the first-stage filtration device, and a first dust collection space is defined between the filter screen and the large dust cup;

the spiral two-stage dust-air separation device is a handheld vacuum cleaner, the air with dust enters the first-stage filtration device via a first air inlet channel, after a first-stage dust-air separation by the filter screen, at least a part of the air with dust is led through a second air inlet channel into a cyclone cylinder of the spiral two-stage dust-air separation device for a second-stage dust-air separation, and is collected in a second dust collection space; then at least a part of the air with dust is led through a third air inlet channel to spiral fan blades of the spiral two-stage dust-air separation device for a third-stage dust-air separation, and is collected in a third dust collection space, and the air in the swirling airflow is extracted by a negative pressure, thereby realizing the third-stage dust-air separation.

2. The three-stage cyclone dust cup filtration system according to claim 1, wherein a large cover plate is arranged at an upper portion of the large dust cup, a middle portion of the large cover plate is concaved downward to form a placement space for placing the handheld vacuum cleaner, and a lower end of the handheld vacuum cleaner is mounted in the placement space.

3. The three-stage cyclone dust cup filtration system according to claim 2, wherein a clamping connector is formed in the placement space, and the lower end of the handheld vacuum cleaner is fixedly clamped inside the placement space.

4. The three-stage cyclone dust cup filtration system according to claim 2, wherein the placement space is tapered from top to bottom, and presents a tapered cylinder shaped structure.

5. The three-stage cyclone dust cup filtration system according to claim 2, wherein the filter screen is fixedly arranged on a connecting portion at a lower end of the placement space.

6. The three-stage cyclone dust cup filtration system according to claim 2, wherein the large dust cup is detachably arranged at a lower side of the large cover plate.

7. The three-stage cyclone dust cup filtration system according to claim 2, wherein the large cover plate comprises two portions arranged up and down, structures of the two portions are spliced to form a large air channel, and the large air channel is in communication with the first dust collection space.

8. The three-stage cyclone dust cup filtration system according to claim 7, wherein an interior of the large air channel is of a spiral surface structure.

9. The three-stage cyclone dust cup filtration system according to claim 1, wherein an air inlet of the spiral two-stage dust-air separation device is located at a bottom, the second air inlet channel extends from a position of the air inlet to an upper end of the spiral two-stage dust-air separation device through a lateral side of the spiral two-stage dust-air separation device.

10. A vacuum cleaner, comprising a floor brush, a push rod, a main body and the three-stage cyclone dust cup filtration system according to claim 7, wherein:

the large cover plate is fixedly connected to the push rod, the push rod is of a hollow structure, and the large air channel on the large cover plate is in communication with a hollow chamber of the push rod; dust and the air enters the hollow chamber of the push rod from the floor brush and enters the three-stage cyclone dust cup filtration system through the large air channel on the large cover plate for filtration and separation, and the separated air enters the main body of the handheld vacuum cleaner to be discharged.

* * * * *